United States Patent [19]

Bals et al.

[11] Patent Number: 4,755,917

[45] Date of Patent: Jul. 5, 1988

[54] HEADLIGHT FOR VEHICLES, IN PARTICULAR MOTOR VEHICLES

[75] Inventors: Josef Bals; Horst Flerlage; Diethard Raeder; Dieter Wystrach; Klaus Hegemann, all of Lippstadt, Fed. Rep. of Germany

[73] Assignee: Hella KG Hueck & Co., Lippstadt, Fed. Rep. of Germany

[21] Appl. No.: 50,523

[22] Filed: May 13, 1987

[30] Foreign Application Priority Data

Aug. 7, 1986 [DE] Fed. Rep. of Germany ..... 3626726

[51] Int. Cl.[4] ..... F21V 29/00

[52] U.S. Cl. ..... 362/267; 362/294

[58] Field of Search ..... 362/267, 294

[56] References Cited

U.S. PATENT DOCUMENTS

| | | | |
|---|---|---|---|
| 1,363,261 | 12/1920 | Nirdlinger | 362/294 |
| 1,963,949 | 6/1934 | Adams et al. | 362/294 |
| 3,593,017 | 7/1971 | Cibie | 362/294 |
| 3,695,009 | 10/1972 | Ousteen | 362/267 |
| 3,784,808 | 1/1974 | Mori | 362/294 |
| 3,878,505 | 4/1975 | Seibert | 362/294 |
| 4,015,114 | 3/1977 | Paajanen et al. | 362/294 |
| 4,232,360 | 11/1980 | Vakil et al. | 362/294 |
| 4,323,954 | 4/1982 | Florence et al. | 362/267 |
| 4,405,974 | 9/1983 | Quiogue | 362/294 |
| 4,546,420 | 10/1985 | Wheeler et al. | 362/294 |
| 4,635,173 | 1/1987 | Dressler et al. | 362/294 |

FOREIGN PATENT DOCUMENTS

| | | | |
|---|---|---|---|
| 3319411 | 1/1984 | Fed. Rep. of Germany | 362/294 |
| 674271 | 10/1929 | France | 362/294 |
| 45475 | 5/1935 | France | 362/294 |
| 1293077 | 4/1962 | France | 362/294 |

*Primary Examiner*—James C. Yeung
*Attorney, Agent, or Firm*—Max Fogiel

[57] ABSTRACT

A headlight for a motor vehicle in which an interior space is enclosed by a housing and a cover lens. The interior space communicates with the surrounding outside atmospheric air through a duct that has an inlet opening and an outlet opening. The duct contains reversably-acting hygroscopic desiccating substance which provides less resistance to flow of air into and out of the interior space, than any other leakage points in the headlight. The duct has a portion projecting into the interior space, and has a substantially high permeability for water molecules in a mixture of water-vapor and air. This portion of the duct resists air flow in establishing pressure equilibrium between the inlet opening and the outlet opening of the duct, so that at least a larger part of air in the duct passes through the inlet and outlet openings. One of these openings is in the interior space, whereas the other opening is located in the atmosphere. The aforementioned portion of the duct inhibits transmission of air through walls of the duct, so that maximum air flow passes through the hygroscopic desiccating substance.

14 Claims, 2 Drawing Sheets

HEADLIGHT FOR VEHICLES, IN PARTICULAR MOTOR VEHICLES

Figure 1:
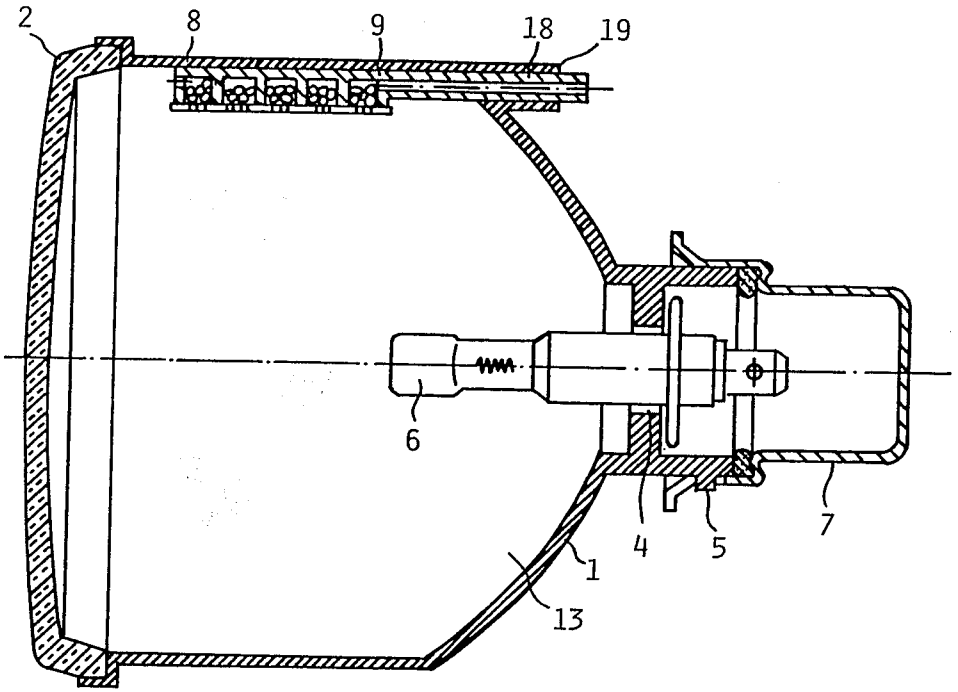

The present invention relates to a headlight for vehicles, in particular motor vehicles, with an interior space enclosed by the reflector and the glass lens or by the housing and the glass lens, containing air which is in communication with the atmospheric air surrounding the headlight by way of a duct with at least one inlet and one outlet opening, with a reversibly-acting hygroscopic desiccating agent filled into said duct which provides a slight resistance to leakage of air from the interior of the headlight.

Such a headlight, already known from the German Offenlegungsschrift DE-OS No. 22 22 449, consists essentially of a bowlshaped reflector, a glass lens in front of the interior of the reflector, and incandescent globe mounted in an opening in the apex of the reflector, and a duct formed from a rodshaped tube filled with a desiccating agent located in a hot zone above the incandescent globe. The tube is inserted through an opening in the reflector and it provides communication between the air enclosed within the headlight and the environmental air by way of the duct which has an inlet opening and an outlet opening. If there is a difference in air pressure between the interior of the headlight and the surrounding atmosphere, air will flow through the duct in the tube, the jacket of which is impermeable to air in the region between the inlet opening and the outlet opening. The reversibly-acting desiccating agent which is filled into the duct in the rod-shaped tube is able to adsorb moisture at low temperatures and to desorb the absorbed moisture at higher temperatures.

With such a headlight it is ensured that, during the driving of the vehicle, the interior of the headlight is adequately free from moisture so that water cannot condense on the reflecting surfaces of the reflector bowl or on the glass lens to cause possible damage by corrosion or interfere with the reflection of the light because of water-droplet formation. In this regard the following details are given in support of the invention:

After switching off the incandescent globe of the headlight, the air within the headlight cools and contracts. This causes air to be sucked into the interior of the headlight from the surrounding atmosphere through the duct in the tube which is filled with desiccating agent until pressure equilibrium is established. Any moisture contained in the inflowing air is taken up on the desiccating agent by adsorption. For this reason, moisture cannot gain access to the interior of the headlight.

After the incandescent globe of the headlight is switched on, the temperature of the air within the headlight increases which causes it to expand and flow out through the duct of the tube filled with the desiccating agent. Because of the heating of the desiccating agent the adsorbed moisture is desorbed and entrained in the escaping hot air. This regenerates the desiccating agent. The rod-shaped tube is disposed at a short distance above the incandescent globe so that the desiccating agent will be heated to the highest possible desorption temperature by the switched-on incandescent globe.

Furthermore, when the vehicle is being driven, there is a transitory build up of air pressure due to the frequent passing of other vehicles travelling in the opposite direction or when passing trees and buildings and similar objects. The effect of this is to cause air to flow in through the duct filled with the desiccating agent into the interior of the headlight and the desiccating agent adsorbs any moisture present in the inflowing air, even if the desiccating agent is saturated with moisture before the pressure increase because the water adsorption capacity of the desiccating agent increases directly with the pressure. When the pressure drops again, air flows out through the duct and moisture is desorbed from the desiccating agent because of the decrease in pressure and it is entrained in the out-flowing air. Because of this effect, satisfactory dryness of the air within the headlight is ensured, even if the desiccating agent has not reached saturation point and/or the air surrounding the headlight has a lesser moisture content than the air within the headlight.

During the periods of time when the vehicle is not being driven and which are relatively long in comparison to the actual driving periods, there is an especially great danger that the moisture of the air within the headlight can increase greatly and thus water can condense on the reflection surface of the reflector and on the inside surface of the glass lens. In this regard the following details are given in support of the invention:

With cost-effective mass production methods, it is scarcely possible to manufacture a headlight which is absolutely airtight. Because of unavoidable leakage points in the headlight it is possible for water to enter by capillary action and diffusion of water vapour takes place between the air with a low moisture content present in the interior of the headlight and the surface of the water present in the water-filled capillary spaces which are in communication with the interior of the headlight. It is also possible for moisture to gain access to the interior of the headlight by permeation through the walls of a reflector fabricated from a synthetic plastics material. Temperature difference between day and night, and variable energy radiation, because of solar radiation and its interruption by passing clouds, and so forth, can often bring about sufficient activation of the desiccating agent and an adequate flow of air for pressure equilibration through the duct filled with desiccating agent. However, the activation of the desiccating agent and the flow of air, in the case of a vehicle which has been standing idle for long periods of time, may be too slight to ensure adequate dryness of the air within the headlight.

Especially in the phases during which the air pressure within the headlight and in the environment are the same, that is to say, when there is no flow of air through the duct, the danger arises that the moisture content of the air within the headlight will increase so sharply that water will be able to condense within headlight when there is a drop in temperature. Undoubtedly, the desiccating agent in the vicinity of the opening in the duct into the interior of the headlight can adsorb moisture from the air but, none the less, the amount of water adsorbed can be very slight because the area of the contact zone between the desiccating agent and the air within the headlight is very small and the saturation point of the desiccating agent in this restricted contact zone is rapidly reached.

The object of the present invention is the further development of a motor vehicle headlight of the type initially described, so that the advantages already described may be fully exploited and the desiccating agent contained in the duct will have such an area of contact with the moist air within the headlight so that it will adsorb enough of the moisture from the air within the headlight, even during the periods of time when the motor vehicle is standing idle, so that condensation of water within the headlight, due to falling temperature, will be avoided.

The present invention achieves this object by making provision for at least a portion of the wall of the duct located inside the headlight to be porous or to have a very fine mesh structure so that it will have a high permeability for water molecules in a water-vapour/air mixture and it will possess so great a resistance to the flow of air that at least the greater part of the air flowing through the duct to establish pressure equilibrium will pass through the inlet and outlet openings of the tube. Under such circumstances, the effectiveness of the desiccating agent increases as the proportion of the air flowing through the inlet and outlet openings increases.

In the case of a reflector which has a rectangular opening for the passage of the reflected light, it is an additional advantage if the duct is located in the upper flattened wall section of the reflector which is not involved in the reflection of the light. With such an arrangement, the part of the wall of the duct which is permeable to water molecules can be formed by the total upper flattened wall section of the reflector.

It is an additional advantage if the part of the duct containing the desiccating agent has a meander design or is spiral-shaped. With such an arrangement, the air flowing through the duct travels a relatively long pathway over the desiccating agent and thus the moisture desorbed from it is completely entrained in the stream of air flowing to the outside atmosphere and, conversely, there is excellent adsorption of the moisture from air flowing into the interior of the headlight from the outside.

There is a further advantage to be gained if the meander- or spiral-shaped duct of a cup-shaped housing is made up of web-shaped wall sections inserted into the cup-shaped housing to form a permeable layer covering the cup-shaped housing. Such a design is very simple and may be manufactured very cost effectively.

It is likewise expedient for the reversibly-acting hygroscopic desiccating agent to consist of small particles such as granules or chips, for example.

In addition to this, it is also advantageous for the duct to consist of a component which may be firmly inserted into an opening through the reflector or the housing in a self-locking manner. Such a component is very simple and easy to install and, if defective, it may be readily be replaced.

Another advantage is derived from locating the duct filled with desiccating agent in a hood covering the light beam from the incandescent globe. This does not decrease the area of the reflection surface of the reflector and the duct filled with the desiccating agent is optimally located in a hot zone within the space enclosed by the reflector.

Figure 2:
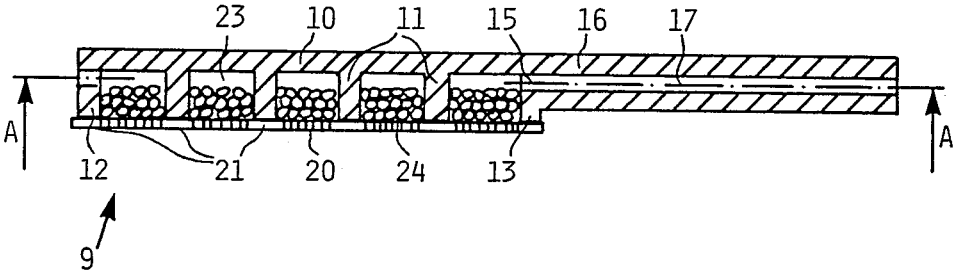
Figure 3:
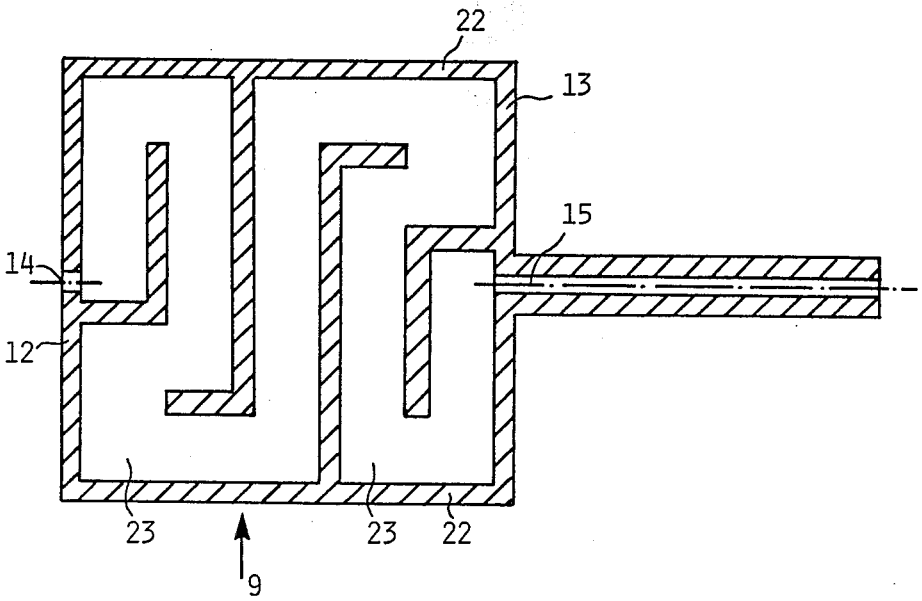

The invention is illustrated in the drawings in which:

FIG. 1 is a vertical section through the centre of a reflector within which a duct filled with desiccating agent is located above the incandescent globe, FIG. 2 is a detail at X on an enlarged scale of the duct filled with desiccating agent and FIG. 3 is a horizontal section along line A—A in FIG. 2.

The headlight illustrated in FIG. 1 has an interior space 13 defined by a reflector 1, which has a rectangular light-outlet opening, and the cover glass lens 2. There is an opening 4 in the apex of the reflector which is surrounded by a neck-shaped extension 5 on the rear surface of the reflector. An incandescent globe 6 is inserted from the rear into the reflector 1 through the opening 4. A cover cap 7 is placed on over the neck-shaped extension 5. A flat rectangular component 9 made from synthetic plastics material is fastened by its base 10 to the inside of the flat upper wall section 8 of the rectangular cross-section reflector 1 by means of an adhesive. There are L-shaped webs moulded onto the underside of the base 10 so that they form a channel with a meander design FIG. 3. This channel terminates centrally at both ends where the walls 12, 13 of the component 9 run parallel to the plane of the cover lens 2 at the front end of the reflector. There are openings 14, 15 in the end walls 12, 13 respectively of component 9. There is a tube 16 moulded onto the outside of the wall 13 facing towards the rear of the reflector 1. The bore of said tube 16 is aligned with the opening 15 in the wall 13. The tube 16 passes through an opening 18 in a collar extension 19 at the rear of the reflector 1 and said tube is fixed into said opening 18 by means of an adhesive. The channel 23 with the meander design in the flat rectangular component 9 is covered over by means of a sheet 20 of material which is permeable to water vapour This sheet 20 is fastened by means of adhesive to the underside of the walls 12, 13, 22 of component 9 so that it encloses the channel 23 to form a duct so that the air within the reflector 1 is in communication with the external environmental air by way of the opening 14 in wall 12, channel 23, the opening 15 in wall 14 and the bore 17 of the tube 16. The duct of meander design is filled with a granular, reversibly-acting hygroscopic desiccating agent 24. The channel 23 of meander design is filled to the extent of slightly less than 100 percent with the desiccating agent 24.

The desiccating agent may consist of a porous molded body, and the permeable section of the wall of the duct may be fabricated from cellophane or silicone rubber.

The duct may be contained in a component which is inserted in a self-locking manner through an opening in the reflector or the housing.

Furthermore, the duct filled with the desiccating agent may be located in a hood in the path of the light beam from the incandescent globe.

The claims defining the invention are as follows:

1. A headlight for a motor vehicle, comprising: a housing and a cover lens enclosing an interior space of said headlight; duct means with at least one inlet opening and one outlet opening; air in said interior space communicating with atmospheric air surrounding the headlight through said duct means; reversibly-acting hygroscopic desiccating means in said duct means and providing substantially less resistance to flow of air into and out of said interior space than any other leakage points in the headlight; said duct means having a portion projecting into said interior space and having a substantially high permeability for water molecules in a mixture of water-vapor and air, said portion of said duct means resisting air flow in establishing pressure equilibrium between said inlet opening and said outlet opening so that at least a larger part of air in said duct means passes through said inlet opening and said outlet opening, one of said openings being in said interior space and the other one of said openings being in the atmosphere; said portion of said duct means inhibiting substantially transmission of air through walls of said duct means; so that maximum air flow passes through said hygroscopic desiccating means.

2. A headlight as defined in claim 1, wherein said portion of said duct means is comprised of cellophane.

3. A headlight as defined in claim 1, wherein said portion of said duct means being comprised of silicone rubber.

4. A headlight as defined in claim 1, wherein said housing comprising reflector means, said duct being located in a section of a wall of said reflector means.

5. A headlight as defined in claim 4, wherein said reflector means has a rectangular opening for passage of reflected light, said duct means being located in an upper flat wall section of said reflector means and being outside paths of light reflections.

6. A headlight as defined in claim 1, wherein said duct means with said desiccating means has a meander shape.

7. A headlight as defined in claim 1, wherein said duct means with said desiccating means is spiral-shaped.

8. A headlight as defined in claim 1, wherein said duct means with said desiccating means comprises a substantially flat rectangular component formed by L-shaped webs molded onto a base of said component, said component having outside walls and a sheet of water-vapor permeable material covering entirely said component's underside.

9. A headlight as defined in claim 1, wherein said hygroscopic desiccating agent is comprised of substantially small particles.

10. A headlight as defined in claim 1, wherein said desiccating means comprises a porous molded body.

11. A headlight as defined in claim 1, wherein said duct means holding said desiccating means being less than fully filled with said desiccating means.

12. A headlight as defined in claim 1, wherein said duct means exclusive of said portion having a substantially high permeability is molded integrally with said housing.

13. A headlight as defined in claim 1, wherein said duct means comprises a component insertable through an opening in said housing and being lockable in place.

14. A headlight as defined in claim 1, including hood means in path of a light beam from an incandescent globe, said duct means with said desiccating means being located in said hook means.

* * * * *